US008248326B2

(12) United States Patent
Ooya et al.

(10) Patent No.: US 8,248,326 B2
(45) Date of Patent: Aug. 21, 2012

(54) IMAGE DISPLAY APPARATUS AND MANUFACTURING METHOD THEREOF

(75) Inventors: Tsuyoshi Ooya, Atsugi (JP); Hisafumi Ebisawa, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 641 days.

(21) Appl. No.: 12/335,968

(22) Filed: Dec. 16, 2008

(65) Prior Publication Data

US 2009/0153444 A1 Jun. 18, 2009

(30) Foreign Application Priority Data

Dec. 18, 2007 (JP) ..... 2007-326213

(51) Int. Cl.
*G09G 3/22* (2006.01)
*H01J 63/00* (2006.01)

(52) U.S. Cl. ..... 345/55; 313/496

(58) Field of Classification Search ..... None
See application file for complete search history.

(56) References Cited

U.S. PATENT DOCUMENTS 7,230,386 B2 * 6/2007 Yui et al. ..... 315/85
7,298,094 B2 * 11/2007 Yui ..... 315/161
2005/0286062 A1 12/2005 Yui
2006/0132394 A1 6/2006 Hayama et al.
2006/0132396 A1 6/2006 Yui
2008/0150842 A1 6/2008 Ebisawa et al. ..... 345/76

FOREIGN PATENT DOCUMENTS

JP 2006-47987 2/2006
JP 2006-171502 6/2006
JP 2006-195444 7/2006

* cited by examiner

*Primary Examiner* — K. Wong
(74) *Attorney, Agent, or Firm* — Fitzpatrick, Cella, Harper & Scinto

(57) ABSTRACT

An image display apparatus includes a face plate with a plurality of light-emitting regions, a rear plate with electron-emitting devices corresponding to the plurality of light-emitting regions, respectively, and a drive circuit that drives the electron-emitting devices. The drive circuit has a correction circuit that calculates a correction value evaluated by influence of emitted electrons from electron-emitting devices which correspond to light-emitting regions around the light-emitting region to be corrected, and corrects a signal input to the electron-emitting device corresponding to the light-emitting region to be corrected based on the correction value. The correction circuit has an adjustment circuit that adjusts the correction value based on variation of characteristics of the plurality of light-emitting regions. Therefore, an image display having improved correction performance and lesser display unevenness can be performed.

7 Claims, 13 Drawing Sheets

IMAGE DISPLAY APPARATUS AND MANUFACTURING METHOD THEREOF

BACKGROUND OF THE INVENTION

1. Field of the Invention

The present invention relates to an image display apparatus and a manufacturing method thereof.

2. Description of Related Art

It is known that a phenomenon called halation emission occurs in an image display apparatus using an electron beam. When an electron emitted from an electron source collides with a phosphor, the phosphor emits light. At this time, not only occurs the light emission of the phosphor but also scattering of electrons occurs (FIG. 3A). Backward scattered electrons scattered around the phosphor by scattering cause peripheral phosphors to emit light. This light emission is called halation emission.

The backward scattered electrons almost uniformly spread from a beam position in the form of a circle (FIG. 3B). However, in an image display apparatus employing spacers, since backward scattered electrons are blocked by the spacer (FIGS. 4A and 4B), an amount of halation emission at a position adjacent to the spacer is different from an amount of halation emission at a position unadjacent to the spacer. For this reason, it is known that spacer unevenness, which is luminance difference or color unevenness (color difference $\Delta u'v'$), occurs as a particular problem.

As a method of correcting the spacer unevenness, Japanese Patent Application Laid-Open (JP-A) No. 2006-047987 describes a configuration that corrects influence of halation emission occurring at peripheral pixels by light emission from luminescent spot in an electron beam display apparatus. Japanese Patent Application No. 3870210 (JP-A No. 2006-171502) and Japanese Patent Laid-Open (JP-A) No. 2006-195444 describe configurations that perform adjustment using a values depending on an emission color in an emitting region to reduce deterioration in halation. JP-A No. 2006-195444 describes, in particular, a configuration that adjusts an amount of correction by using an adjusted value predetermined for each color or an adjusted value which can be dynamically changed in units of colors depending on a lighting pattern of original image data.

SUMMARY OF THE INVENTION

The present inventors had an image displayed on image display apparatuses with the conventional correction method, and checked spacer unevenness caused by halation emission. As a result, the present inventors found degrees of correction for reducing difference of chromatic purity and luminance varies between pixels proximate to spacers and pixels not proximate to spacers.

It is an object of the present invention to provide an image display apparatus having lesser display unevenness in consideration of the above problem.

In order to achieve the above object, the present invention provides an image display apparatus having:

a face plate with a plurality of light-emitting regions;

a rear plate with electron-emitting devices corresponding to the plurality of light-emitting regions, respectively; and a drive circuit that drives the electron-emitting devices, wherein the drive circuit has a correction circuit that calculates a correction value evaluated by influence of emitted electrons from electron-emitting devices which correspond to light-emitting regions around the light-emitting region to be corrected, and corrects a signal input to the electron-emitting device corresponding to the light-emitting region to be corrected based on the correction value, and the correction circuit has an adjustment circuit that adjusts the correction value based on variation of characteristics of the plurality of light-emitting regions.

The present invention provides an image display apparatus having:

a face plate with a plurality of light-emitting regions;

a rear plate with electron-emitting devices corresponding to the plurality of light-emitting regions, respectively; and a drive circuit that drives the electron-emitting devices, wherein the drive circuit has a correction circuit that calculates a correction value evaluated by influence of emitted electrons from proximate electron-emitting devices which correspond to light-emitting regions around the light-emitting region to be corrected, and corrects a signal input to the electron-emitting device corresponding to the light-emitting region to be corrected based on the correction value, and the correction circuit has an adjustment circuit that adjusts the correction value based on variation of electron-emitting characteristics of the adjacent electron-emitting devices.

The present invention provides a manufacturing method for an image display apparatus comprising a face plate with a plurality of light-emitting regions, a rear plate with electron-emitting devices corresponding to the plurality of light-emitting regions, respectively, and a drive circuit that drives the electron-emitting devices, wherein the drive circuit has a correction circuit that calculates a correction value evaluated by influence of emitted electrons from electron-emitting devices which correspond to light-emitting regions around the light-emitting region to be corrected, on the light-emitting region to be corrected, and corrects a signal input to the electron-emitting device corresponding to the light-emitting region to be corrected based on the correction value with adjustment according to variation of characteristics of the plurality of light-emitting regions, the method comprising the steps of:

forming the plurality of light-emitting regions on the face plate;

forming a plurality of electron-emitting devices on the rear plate;

measuring characteristics of the plurality of light-emitting regions; and storing the measured characteristics of the plurality of light-emitting regions.

The present invention provides a manufacturing method for an image display apparatus comprising a face plate with a plurality of light-emitting regions, a rear plate with electron-emitting devices corresponding to the light-emitting regions, respectively, and a drive circuit that drives the electron-emitting devices, wherein the drive circuit has a correction circuit that calculates a correction value evaluated by influence of emitted electrons from proximate electron-emitting devices which correspond to light-emitting regions around the light-emitting region to be corrected, on the light-emitting region to be corrected, and corrects a signal input to the electron-emitting device corresponding to the light-emitting region to be corrected based on the correction value with adjustment according to variation of electron-emitting characteristics of the proximate electron-emitting devices, the method comprising the steps of:

forming the plurality of light-emitting regions on the rear plate;

forming the plurality of electron-emitting devices on the rear plate;

measuring electron-emitting characteristics of the plurality of light-emitting regions respectively corresponding to the plurality of light-emitting regions; and storing the measured electron-emitting characteristics of the electron-emitting devices.

According to the present invention, provided is an image display apparatus having lesser display unevenness by improving correction performance.

DESCRIPTION OF THE EMBODIMENTS

Preferred embodiments of the present invention will be illustratively described in detail with reference to the accompanying drawings.

First Embodiment

In an image display apparatus according to the embodiment, a screen is configured by a plurality of pixels. Each of the pixels has a light-emitting region having any one of several different colors, particularly red (R), green (G), and blue (B), as a light-emitting color. Phosphors which emit light by irradiation of electrons are used as light-emitting members constituting the light-emitting region. A pixel having a red light-emitting region, a pixel having a green light-emitting region, and a pixel having a blue light-emitting region are combined to each other, so that a visual neutral color display is realized by controlling emission amount of the respective colors. Each of the pixels has an electron-emitting device corresponding to each of the light-emitting regions. In the embodiment, a surface conduction electron-emitting device display (SED display apparatus) is employed. However, the present invention includes other field emission display (FED display apparatus). These image display apparatuses are preferred embodiments to which the present invention is applied because halation emission may occur on peripheral pixels due to light emission from luminescent spot which is selfluminant.

Figure 13:
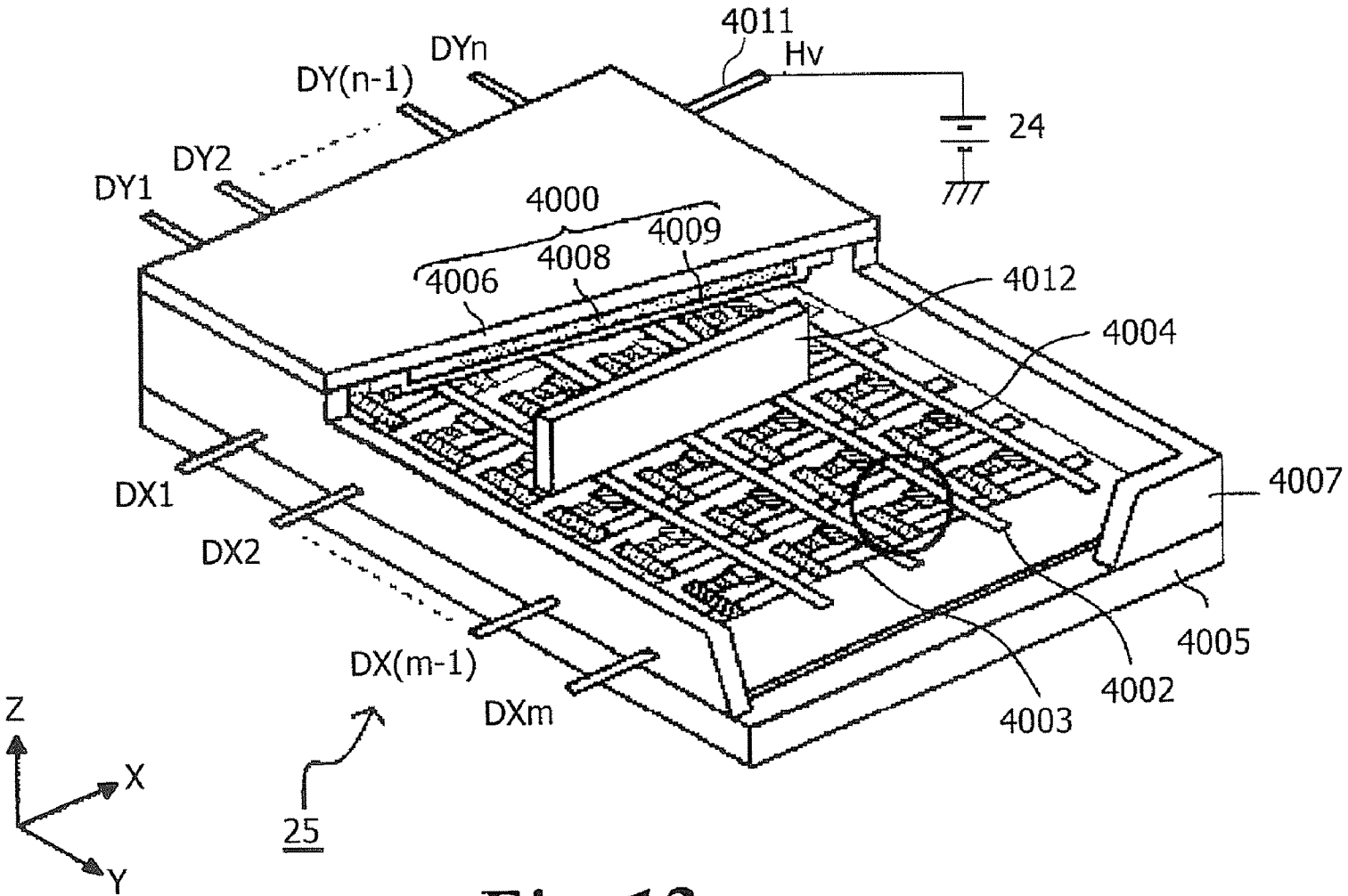
FIG. 13 is a diagram showing a schematic configuration of a display panel.

A configuration of a display panel 25 of the image display apparatus according to the embodiment will be described below with reference to FIG. 13. The display panel 25 shown in FIG. 13 has electron-emitting devices and light-emitting members. In the embodiment described here, as particularly preferable electron-emitting devices, surface conduction electron-emitting devices 4004 are used. As other electron-emitting devices, spint type electron-emitting devices having an emitter cone and a gate electrode combined, electron-emitting devices using carbon fibers such as carbon nanotubes or graphite nanofibers, MIM type electron-emitting devices, and the like can be employed.

The embodiment employs a configuration in which the plurality of surface conduction electron-emitting devices 4004 are connected in the form of a matrix by a plurality of scan signal applying lines 4002 and modulated signal applying lines 4003. Scan signals output from a row-line switch unit 23 are sequentially applied to the scan signal applying lines 4002. Modulated signals output from the column-line switch unit 21 are applied to the modulated signal applying lines 4003. The electron-emitting devices, the scan signal applying lines, and the modulated signal applying lines, the lines being connected to the electron-emitting devices in the form of a matrix, are arranged on a rear plate 4005.

In the embodiment, a phosphor 4008 is used as a light-emitting member. The phosphor 4008 is arranged on a face plate 4006. A metal back 4009 serving as an accelerating electrode to accelerate electrons emitted from the electron-emitting device is arranged on the face plate 4006. An accelerating potential is supplied from a high-voltage power supply 24 to the metal back 4009 through a high-voltage terminal 4011. A glass frame 4007 serving as an outer frame is located between the rear plate 4005 and the face plate 4006, and the rear plate 4005 and the glass frame 4007 are air tightly sealed, and the face plate 4006 and the glass frame 4007 are also air tightly sealed. In this manner, an airtight container is configured by the rear plate 4005, the face plate 4006, and the glass frame 4007. The interior of the airtight container is kept in a vacuum state. Spacers 4012 are arranged in the airtight container, thereby the airtight container is prevented from being collapsed by a pressure difference between the inside of the airtight container and the outside thereof. In FIG. 13, only one spacer 4012 is illustrated. However, in fact, a plurality of spacers are arranged at intervals of several ten lines.

In the display unit having the configuration, a position on the panel almost facing an electron-emitting device is a light-emitting region (light-emitting member) corresponding to the electron-emitting device.

Figure 2:
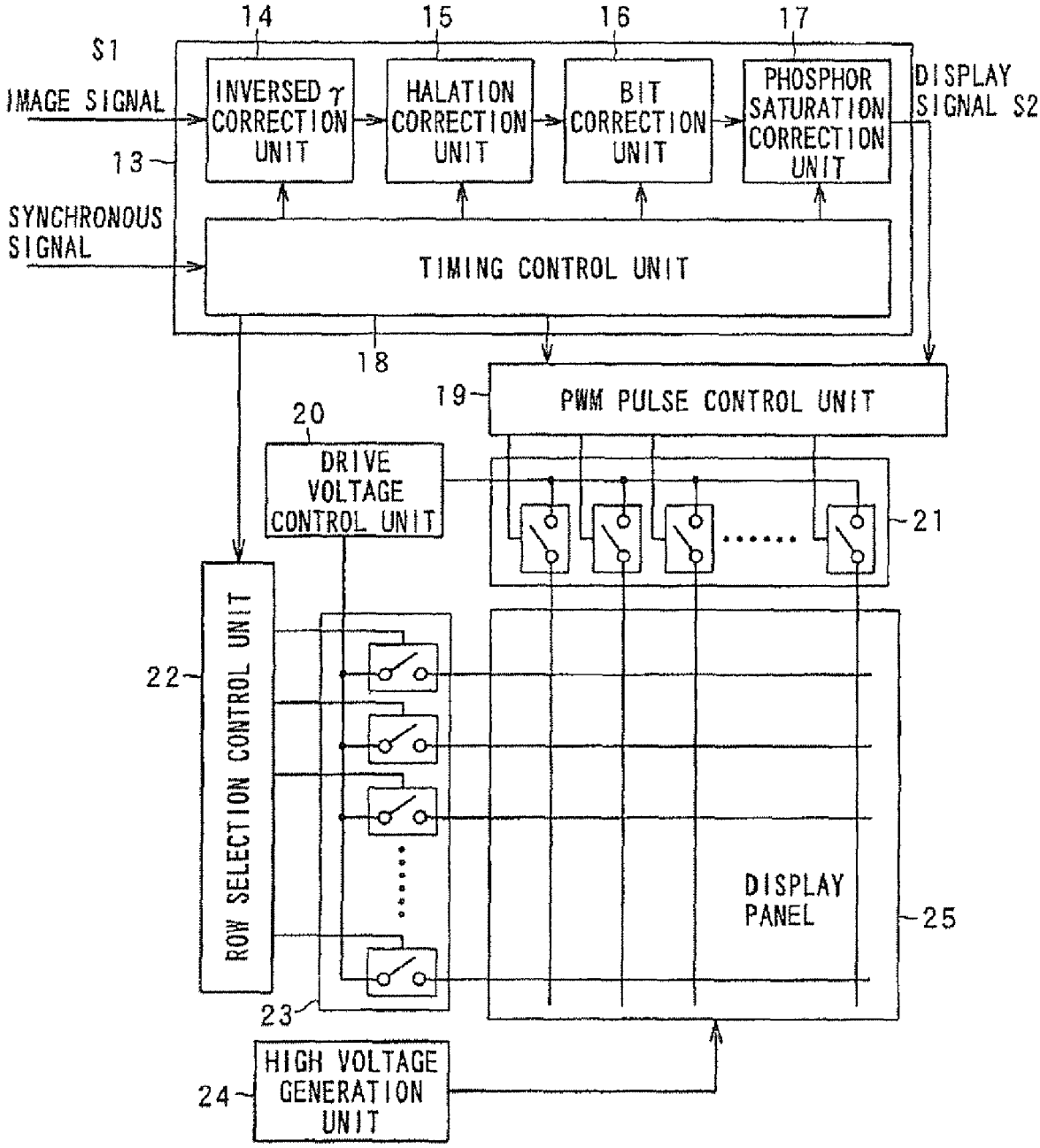
FIG. 2 is a diagram showing a configuration of a drive circuit.

An operation to input a video image and display an image on the SED panel will be described below with reference to FIG. 2. FIG. 2 is a circuit diagram of a drive unit of the image display apparatus according to the embodiment. An input video signal S1 is subjected to signal processing suitable for a display through a signal processing unit 13, and is output as a display signal S2. As functions of the signal processing unit 13 in FIG. 2, only required minimum functional blocks are described in the explanation of the embodiment. In general, an input video signal S1, on the premise of being displayed on CRT, is subjected to nonlinear conversion such as 0.45-power conversion called gamma conversion matched with an input-emission characteristic of a CRT display and then transmitted or recorded. When the video signal is displayed on a display device such as an SED, an FED, or a PDP having a linear input-emission characteristic, an input signal must be subjected to an inverse gamma conversion such as 2.2-power conversion. More specifically, an inverse-γ-correcting unit 14 converts an input video signal into data which is linear with respect to a luminance. An output from the inverse-γ-correcting unit 14 is input to a halation correcting unit 15 serving as a characteristic feature of the embodiment. The halation correcting unit 15 will be described below in detail. An output from the halation correcting unit 15 serves as an input to a BIT correcting unit 16. The BIT correcting unit uniforms the maximum luminance to a predetermined luminance value in order to eliminate a variation in light emission caused by an electron source and a phosphor. An output from the BIT correcting unit serves as an input to a phosphor saturation correcting unit 17 which adjusts an input to make it possible to accurately display output colors and contrast in consideration of gamma characteristics of R, G, and B phosphors. An output from the phosphor saturation correcting unit 17 is output as the video display signal S2 suitable for an SED. A timing control unit 18 generates and outputs various timing signals for operations of the blocks based on a synchronous signal transferred together with the input video signal S1.

A PWM pulse control unit 19 converts the display signal S2 into a drive signal (for example, PWM modulation) suitable for the display panel 25 every horizontal scan cycle (row selection period). A drive voltage control unit 20 controls a voltage that drives the devices arranged on the display panel 25. The column-line switch unit 21 is configured by switch units such as transistors, and applies a drive output from the drive voltage control unit 20 to modulation lines during PWM pulse period, in which the PWM pulse control unit 19 outputs PWM pulse, every horizontal scan cycle (row selection period). A row selection control unit 22 generates a row selection pulse that drives the devices on the display panel. The row-line switch unit 23 is configured by switch units such as transistors, and outputs a drive output from the drive voltage control unit 20, which output accords to a row selection pulse output from the row selection control unit 22, to the display panel 25. A high-voltage power supply 24 generates an accelerating voltage that accelerates electrons emitted from the electron-emitting device arranged on the display panel 25 to cause the electrons to collide with the phosphor. In this manner, the display panel 25 is driven to display a video image.

The drive circuit according to the present invention includes the signal processing unit 13, the PWM pulse control unit 19, the drive voltage control unit 20, the column-line switch unit 21, the row selection control unit 22, and the row-line switch unit 23.

Figure 1:
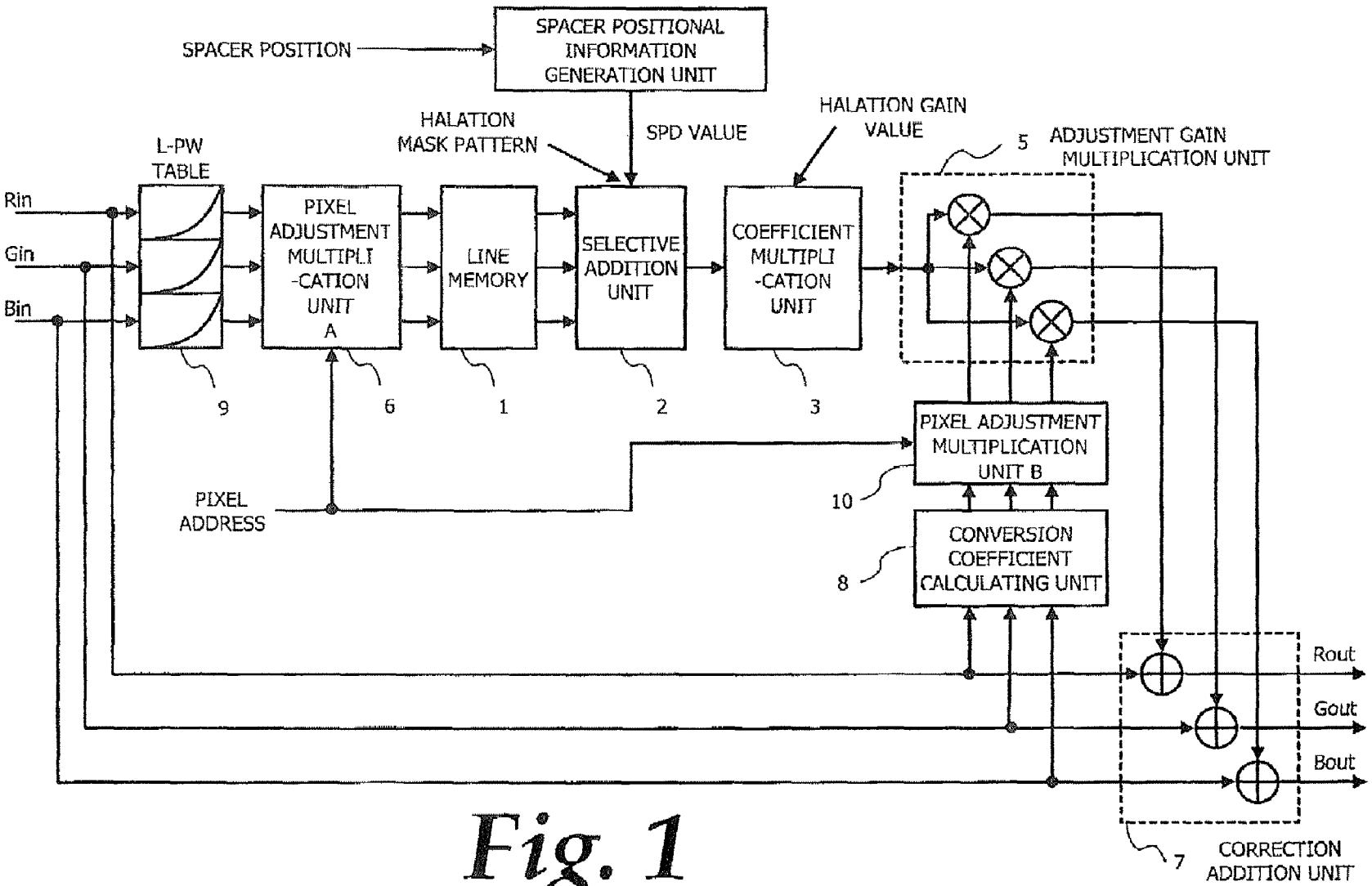
FIG. 1 is a diagram showing a configuration of a halation correction circuit.

The halation correcting unit 15 which is a characteristic feature of the present invention will be described below with reference to FIG. 1. Prior to the explanation of FIG. 1, what halation is will be described below.

Figure 3A:
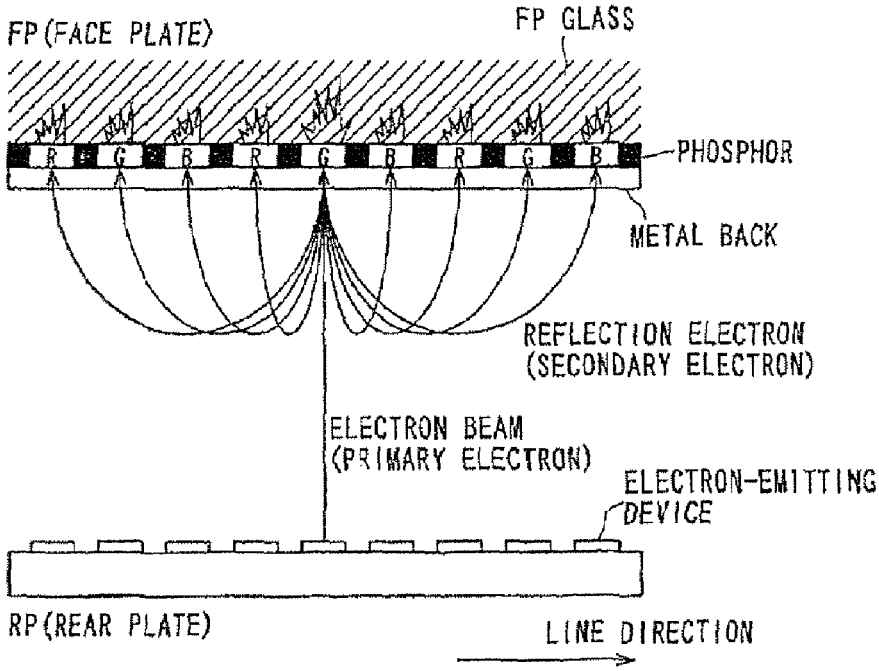
FIGS. 3A and 3B are diagrams for explaining a halation occurrence mechanism at a position adjacent to a spacer.

FIG. 3A shows an image display apparatus in which electron-emitting devices are formed on the rear plate and light-emitting members (in the embodiment, red, blue, and green phosphors) are arranged on the face plate with space between the light-emitting members and the electron-emitting devices. In the image display apparatus, electron beams (primary electrons) emitted from the electron-emitting devices are irradiated on corresponding light-emitting members to emit light. In the image display apparatus, there arises a particular problem that color reproducibility is different from color reproducibility in the desired state. Specifically, for example, if only the blue phosphor is irradiated with electrons to emit blue color light, not pure blue color but light having a color slightly mixed with other colors, that is, light in which green and red colors are mixed is emitted, with poor color saturation.

As a result of studies by the present inventors, the present inventors figured out the cause of the deterioration of chroma saturation. This cause is as follows. Primary electrons emitted from an electron-emitting device impinge on the corresponding light-emitting member so that the light-emitting member may emit light at its luminescent spot. But these primary electrons are reflected by the light-emitting member and impinge on close (and proximate) light-emitting regions of different colors as backward scattered electrons (reflected electrons, secondary electrons). The backward scattered electrons cause peripheral light-emitting members to emit light, thereby deteriorating chroma saturation.

Figure 3B:
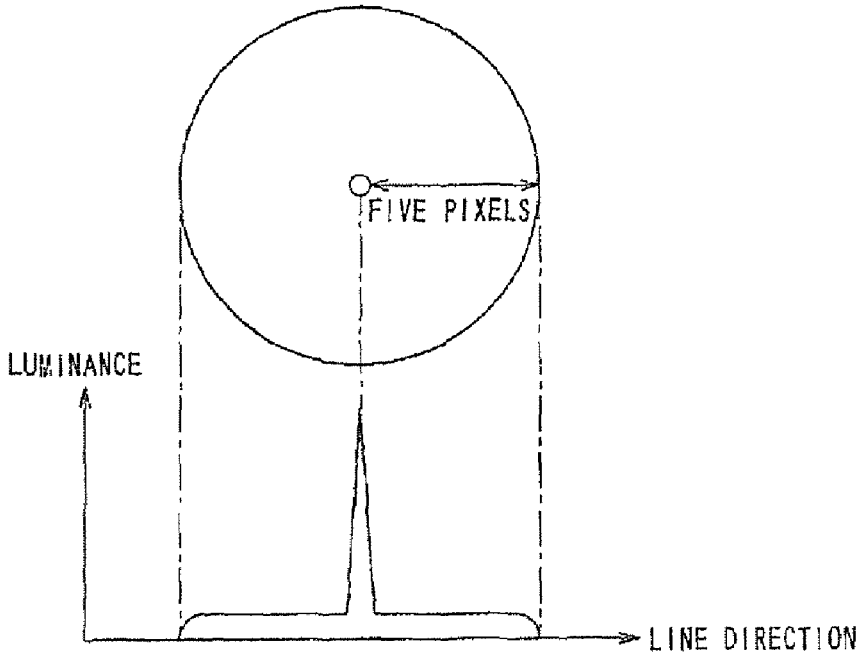
Figure 5:
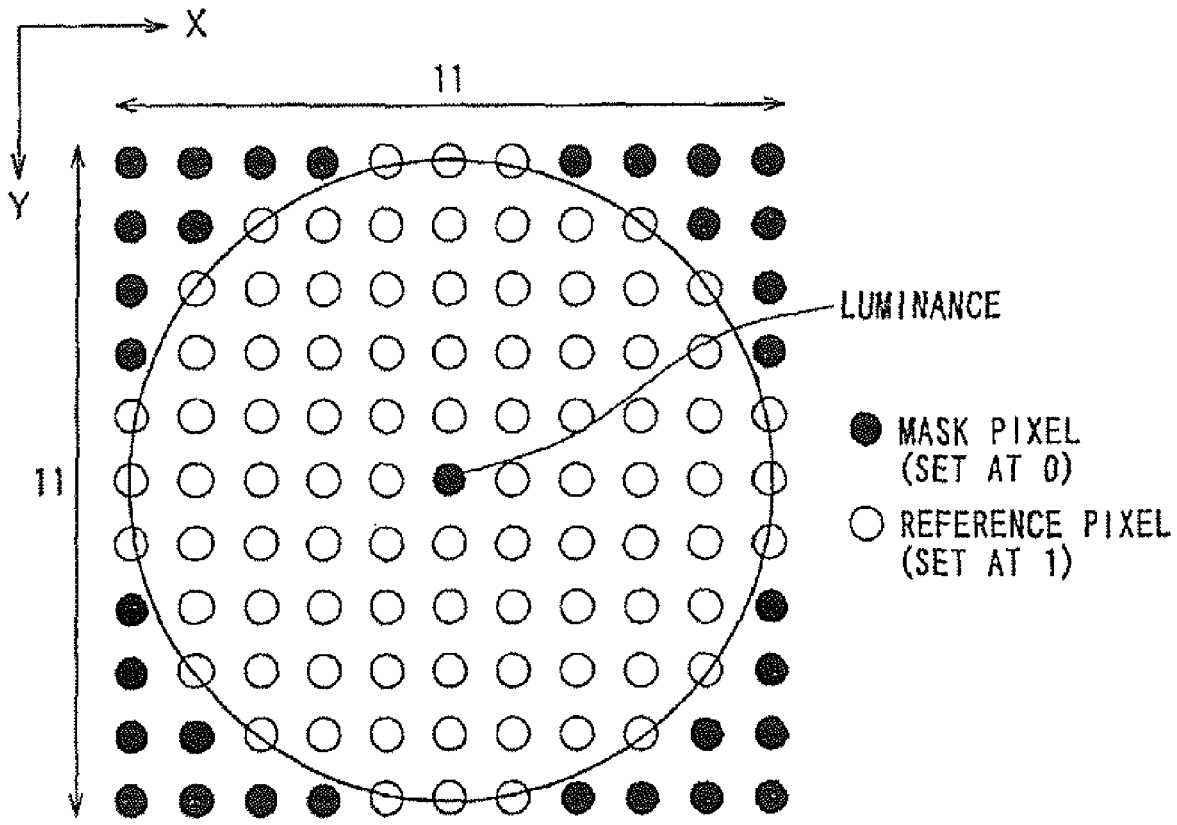
FIG. 5 is an 11×11-halation mask pattern diagram.

A phenomenon that a display device emits light by an influence from the drive of adjacent display devices, such as light emission due to reflected electrons, is referred to as "halation" in the present specification. In the SED, as shown in FIG. 3B, it was found that, when electrons are irradiated on a certain phosphor, halation causes circular light emission around the pixel (light emission is distributed in a cylinder around the luminescent spot if expressed in terms of brightness as a quantity of emitted light). If a radius of this circular region influenced by halation is as long as n number of pixels, a filter as large as (2n+1) number of taps is required as pixel reference range for a halation correction process, which will be described in detail later. Furthermore, it was found that the radius of a region influenced by halation can be uniquely determined reasonably practically by a distance between the face plate on which the fluorescent material is arranged and the rear plate on which the electron source is arranged, a size of the pixels, etc. Therefore, if the distance between the face plate and the rear plate is known, the number of filter taps is determined uniquely. Since n is five (n=5) pixel in the present embodiment, it can be known that the number of filter taps is 11, that is, it is necessary to reference data of 11 pixels×11 lines as shown in FIG. 5 in order to accommodate an influence of halation. In this manner, the radius of the region to which the halation extends is a static parameter obtained from a physical structure (interval between the face plate and the rear plate and pixel size). Therefore, when the same correcting circuit is caused to cope with different SED panels of a plurality of types, a halation mask pattern in FIG. 5 should be changeable as a variable parameter.

Figure 4A:
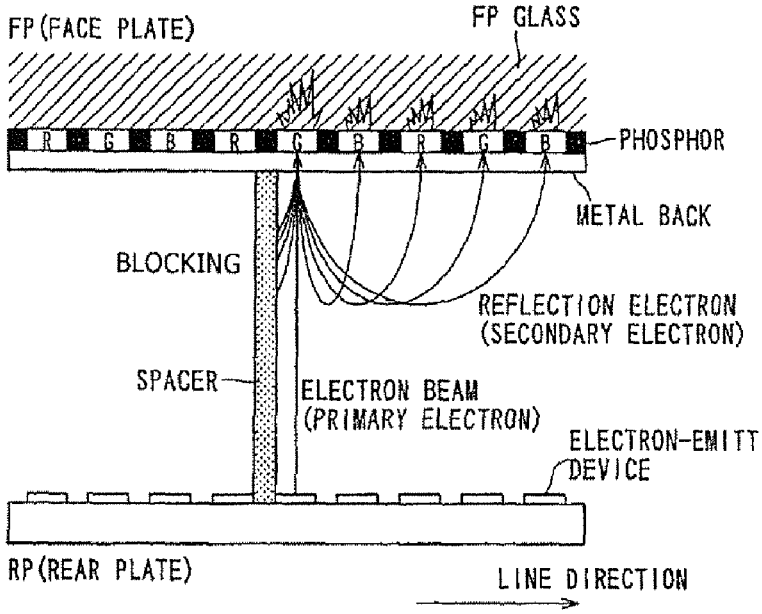
FIGS. 4A and 4B are diagram for explaining a halation occurrence mechanism at a position unadjacent to a spacer.
Figure 4B:
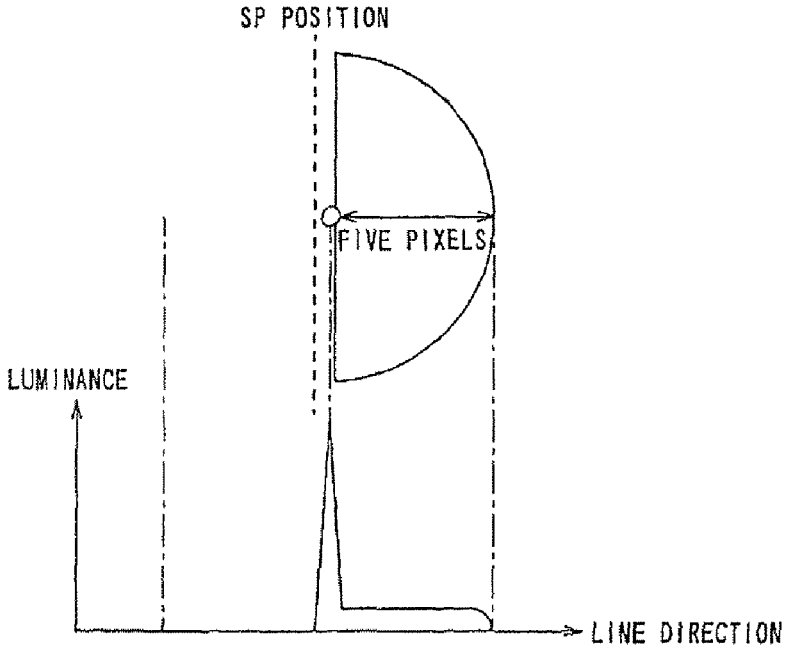

FIGS. 3A and 3B show a case where there is no blocking member such as a spacer on a reflecting path of reflected electrons (not in the vicinity of a spacer). When a blocking member such as a spacer is present (in the vicinity of a spacer), backward scattered electrons (reflected electrons or secondary electrons) are blocked by the spacer as shown in FIG. 4A. For this reason, halation strength is reduced. Thus, in a case where electron beams (primary electrons) are emitted from the electron-emitting device closest to the spacer, it was found that halation has an influence on a semicircular light-emitting range as shown in FIG. 4B. In FIGS. 3A and 4A show R, G, and B phosphors alternately arranged <lateral stripes> in a line direction. However, this is to simplify the explanation, in fact, the R, G, and B phosphors are alternately arranged <longitudinal stripes> in a horizontal direction.

Figure 6A:
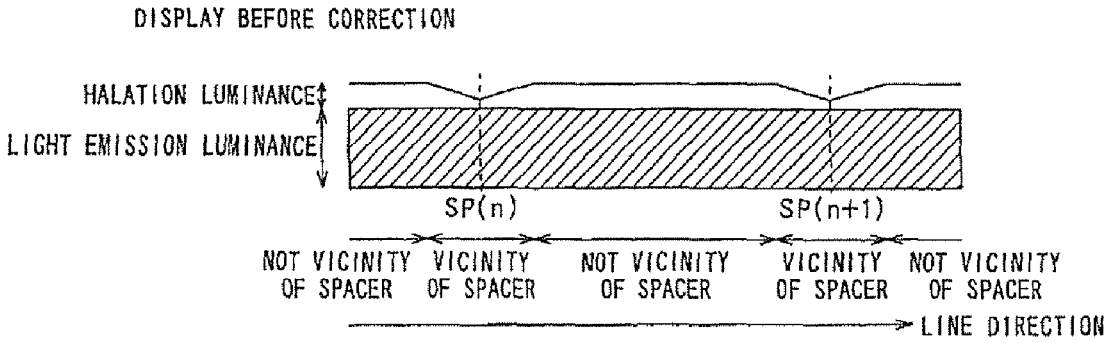
FIGS. 6A and 6B are diagrams for explanation of halation correction performed by a blocked amount adding scheme.

The above operation is an occurrence mechanism of halation explained by using a light-emitting state obtained by one device as an example. In the SED used in the embodiment, plural long spacers are mounted at intervals of several ten lines, extending in a lateral direction. Thus, when overall concolorous lighting is performed, the halation causes a difference between amounts of halation at a position proximate to the spacer and a position not proximate to the spacer. It was confirmed that the difference in quantity of halation causes an inherent problem that color purity changes in the vicinity of the spacer. This problem is referred to as spacer unevenness. A degree of spacer unevenness varies with a lighting pattern of a display image. For example, when an overall blue lighting pattern is displayed, as shown in FIG. 6A, halation luminance is added to blue-light-emitting luminance. Since, at the position proximate to the spacer, an amount of blocking of reflected electrons gradually changes depending on distances from the spacer, a wedge-shaped gradual change in color purity in a range of about 10 lines is visually recognized.

A concrete example of an image display apparatus according to the embodiment and a drive signal correcting method according to the embodiment will be described below with reference to FIG. 1. FIG. 1 is a diagram showing a detailed configuration of the halation correcting unit 15.

Image data inverse-γ-converted and input to the halation correcting unit 15 is converted into data of a format in which an amount of halation emission can be calculated and then given to a line memory 1. The format converting process is performed by an L-PW table (luminance-pulse width table) 9. In general, phosphors have such light-emitting characteristics that an increase rate of the light-emitting luminance decreases when an irradiation time of a beam is longer or when the beam is stronger. Due to the presence of the phenomenon, the L-PW table 9 is needed.

The line memory 1 includes 11 line memories in the embodiment. Original image data are sequentially written in the line memory 1 in units of lines. When the data of the 11 lines are stored, the data of 11 pixels×11 lines are simultaneously read for calculation.

Figure 7:
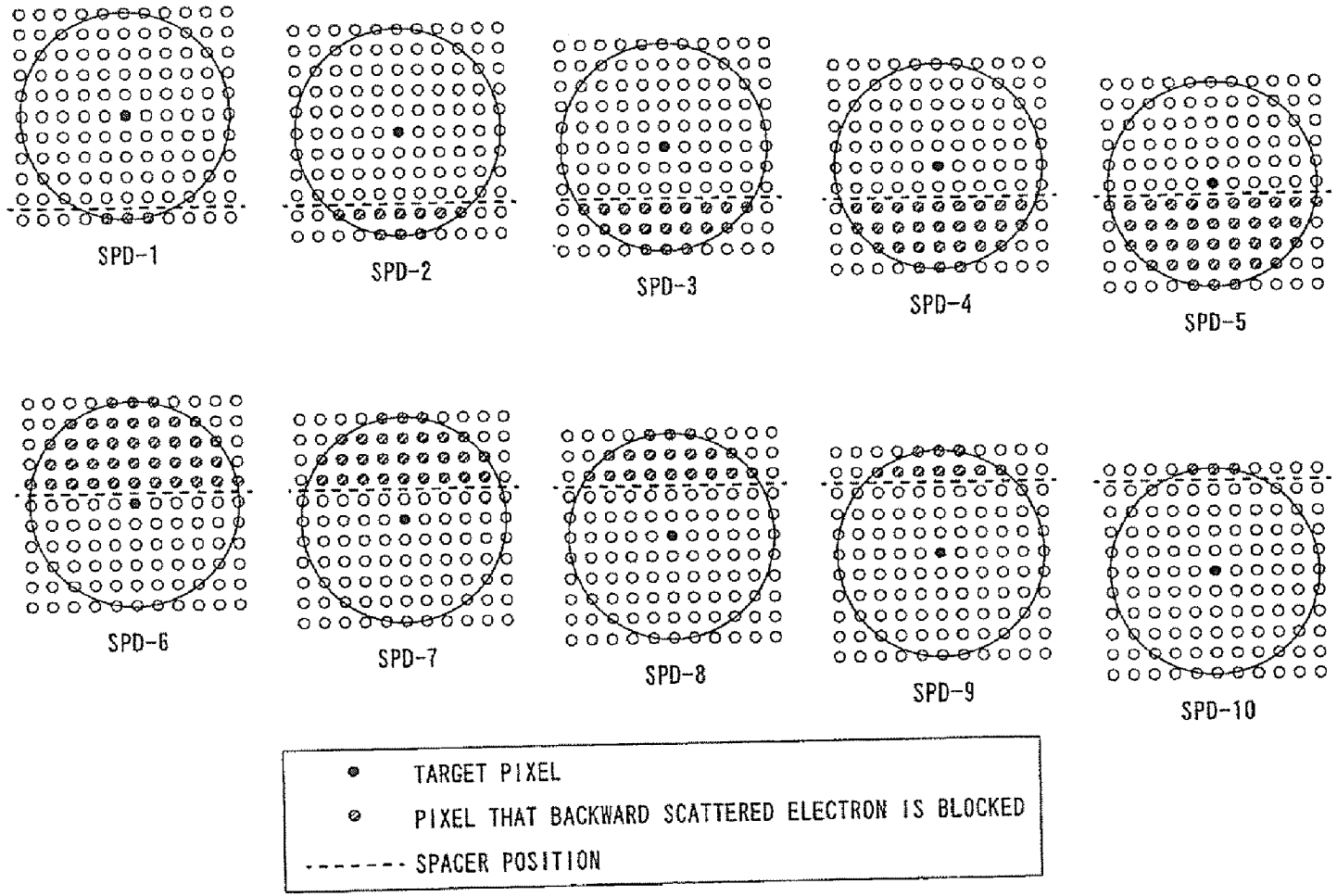
FIG. 7 is a corresponding diagram of pixels where reflected electrons are blocked depending on distances between target pixels and spacers.

The data of 11 pixels×11 lines around a target pixel simultaneously read are referred for an arithmetic operation by a selective addition unit 2, and data of the target pixel are given to a correction addition unit 7. The selective addition unit 2 selectively adds the number of electrons blocked by a spacer among the reflected electrons from pixels around the target pixel, to data of the target pixel proximate to the spacer. It is determined by an SPD (Spacer Distance) value whether the target pixels are at the position proximate to the spacer. This SPD value indicates a positional relationship between the target pixel and the spacer, and is generated by a spacer position information generating unit 4 based on a timing control signal and spacer position information received from the timing control unit 18. As for the target pixel in the vicinity of the spacer, as shown in FIG. 7, there are ten patterns, depending on the SPD value, of the pixels to which the reflected electrons can not reach due to blocking by the spacer. A total amount of lighting related to an amount of blocking can be calculated by selecting pixel values indicated in gray depending on the SPD value and adding the pixel values. Each pixel has red (R), green (G), and blue (B) light-emitting regions. In the configuration, the input signals are input as an R signal, a G signal, and a B signal corresponding to each pixel. Data related to amounts of blocking of the respective colors are accumulated, and a sum of the accumulated results of the respective colors, i.e., R, G, and B is calculated and output from the selective addition unit 2. With respect to a position unadjacent to the spacer, reflected electrons are not blocked by the spacer. For this reason, an addition result may be set to 0. A coefficient multiplication unit 3 multiplies the addition result by a coefficient (halation gain value) representing a percentage of blocked electrons that would contribute to halation. The coefficient falls in the range of 0 to 1, in general. In an actual panel, the coefficient is a value of about 1.5%. Data output from the coefficient multiplication unit 3 is an amount of light emission blocked by a spacer, i.e., an amount of halation emission to be added if no spacer is present. The amount of blocking of the halation emission corresponds to influence of electrons emitted from the proximate electron-emitting devices on the light-emitting region to be corrected in the present invention. Data output from the coefficient multiplication unit 3 corresponds to a correction value calculated by evaluating the influence of the electrons emitted from the proximate electron-emitting devices on the light-emitting region to be corrected in the present invention. As described above, the value is obtained by evaluating image data corresponding to all of the colors at once.

It is known that the amount of halation emission varies with lighting color (phosphor type). It Is known that, if uniform correction is performed to each color, a degree of correction varies and accurate correction cannot be achieved. The correction value is adjusted depending on the lighting color in order to realize uniform correction. More specifically, an adjusting gain multiplication unit 5 multiplies correction data calculated through the coefficient multiplication unit 3 by one of conversion coefficients depending on the R, G, and B phosphors, which coefficients can be obtained from a conversion coefficient calculating unit 8. Thereby, adjustment of an amount of correction is performed. In the configuration in FIG. 1, the conversion coefficient can be selected in consideration of an input image signal (lighting pattern) of pixels to be corrected. However, fixed conversion coefficients predetermined for each color (phosphor type) in advance may be used. Using the conversion coefficients, correction data of an output from the coefficient multiplication unit 3 is converted into an optimum amount of correction according to the phosphor types of the pixels to be corrected.

Figure 6B:
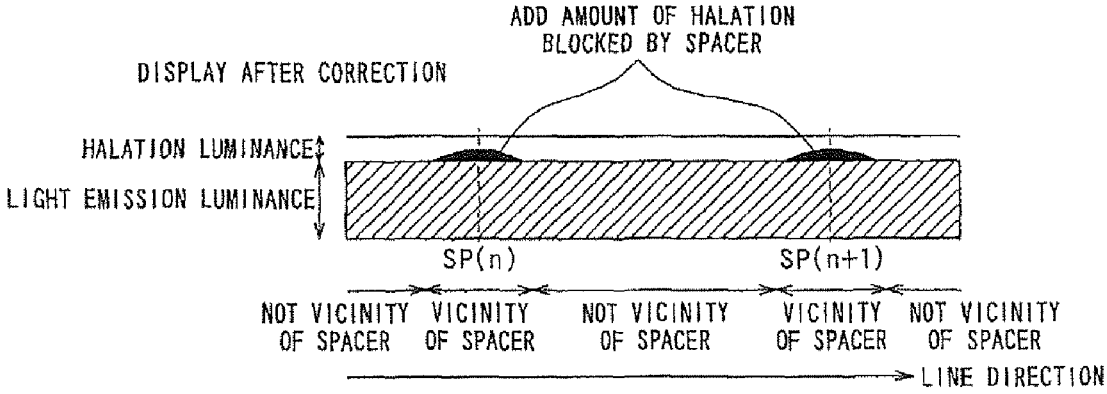

The correction addition unit 7 adds the adjusted correction amount thus obtained to original image data, and outputs the result as a correction image. In this manner, in a pixel proximate to a spacer, a correction value corresponding to blocked amount by the spacer of halation of reflected electrons is added, and a difference between color purities at positions proximate and non-proximate to the spacer is reduced in an entire screen. More specifically, as shown in FIG. 6A, a gradual change in color purity occurring at the position adjacent to the spacer before the correction is suppressed by the above correction as shown in FIG. 6B. In this manner, space unevenness caused by halation can be corrected.

When the present inventors operate an actual SED panel by using the correcting method described above to evaluate its effect, the present inventors found that degrees of correction reducing differences in color purity and luminance at the position unadjacent to the spacer and the position adjacent to the spacer, varies with pixels. More specifically, it was found that when adjustment of the correction value is performed with overall lighting, overcorrected pixels and undercorrected pixels are generated, and some pixel needs unique adjustment to the correction values. The overcorrection and the undercorrection mean that variation of characteristics between pixels exceeds an allowable margin of error for spacer unevenness.

Therefore, in the embodiment, not the same values are applied to pixels to be corrected, but correction values obtained by performing adjustment depending on a variation in pixel characteristics are applied. More properly, a configuration is employed, in which not only a correction amount is adjusted depending on phosphor types of the pixels but also adjustment of the amount of correction is performed in consideration of the variation in characteristic of the pixels. In the embodiment, as subsequent parts of the L-PW table 9 and the conversion coefficient calculating unit 8, a pixel adjustment multiplication unit A6 and a pixel adjustment multiplication unit B10 are arranged. In either or both the pixel adjustment multiplication unit A and the pixel adjustment multiplication unit B, adjustment depending on a variation in pixel characteristic is performed. The pixel adjustment multiplication unit A6 and the pixel adjustment multiplication unit B10 correspond to the adjustment circuits according to the present invention. The L-PW table 9 and the pixel adjustment multiplication unit A6 may be mounted as one circuit, and adjustment may be performed by the L-PW table 9. Similarly, the conversion coefficient calculating unit 8 and the pixel adjustment multiplication unit B10 may be mounted as one circuit, and adjustment may be performed by the conversion coefficient calculating unit 8.

A reason why one or two calculating units are used for adjustment depending on pixels will be described below. An amount of halation emission, as is also apparent from an occurrence mechanism, is determined by two factors, that is, a factor of how much electrons are scattered at an irradiated phosphor and impinges on a peripheral phosphor and a factor of how much light emission occurs when a certain number of scattered electrons impinges on the phosphor. More specifically, each of the pixels has two roles: one is a role as a pixel (electron scattering pixel) which scatters electrons from an electron source; and the other is a role as a pixel (halation emission pixel) on which scattered electrons impinges. Since scattering of electrons and light emission of a phosphor by scattered electrons are independent phenomena, even though the same pixel is involved with halation, an influence on halation when the pixel is an electron scattering pixel is different from that when the pixel is a halation emission pixel. Adjustment related to difference in influences on halation due to electron scattering pixel (which influences are the number of scattered electrons) is performed by the pixel adjustment multiplication unit A6. Adjustment related to difference in influences on halation due to halation emission pixel (which influences are amount of light emission caused by a certain number of scattered electrons) is performed by the pixel adjustment multiplication unit B10. In this manner, both the difference between pixels serving as electron scattering pixels and the difference between pixels serving as halation emission pixels can be corrected. When only one of the difference between the pixels serving as the electron scattering pixels and the difference between the pixels serving as the halation emission pixels is corrected, only corresponding one of the adjustment circuits is employed.

Figure 9:
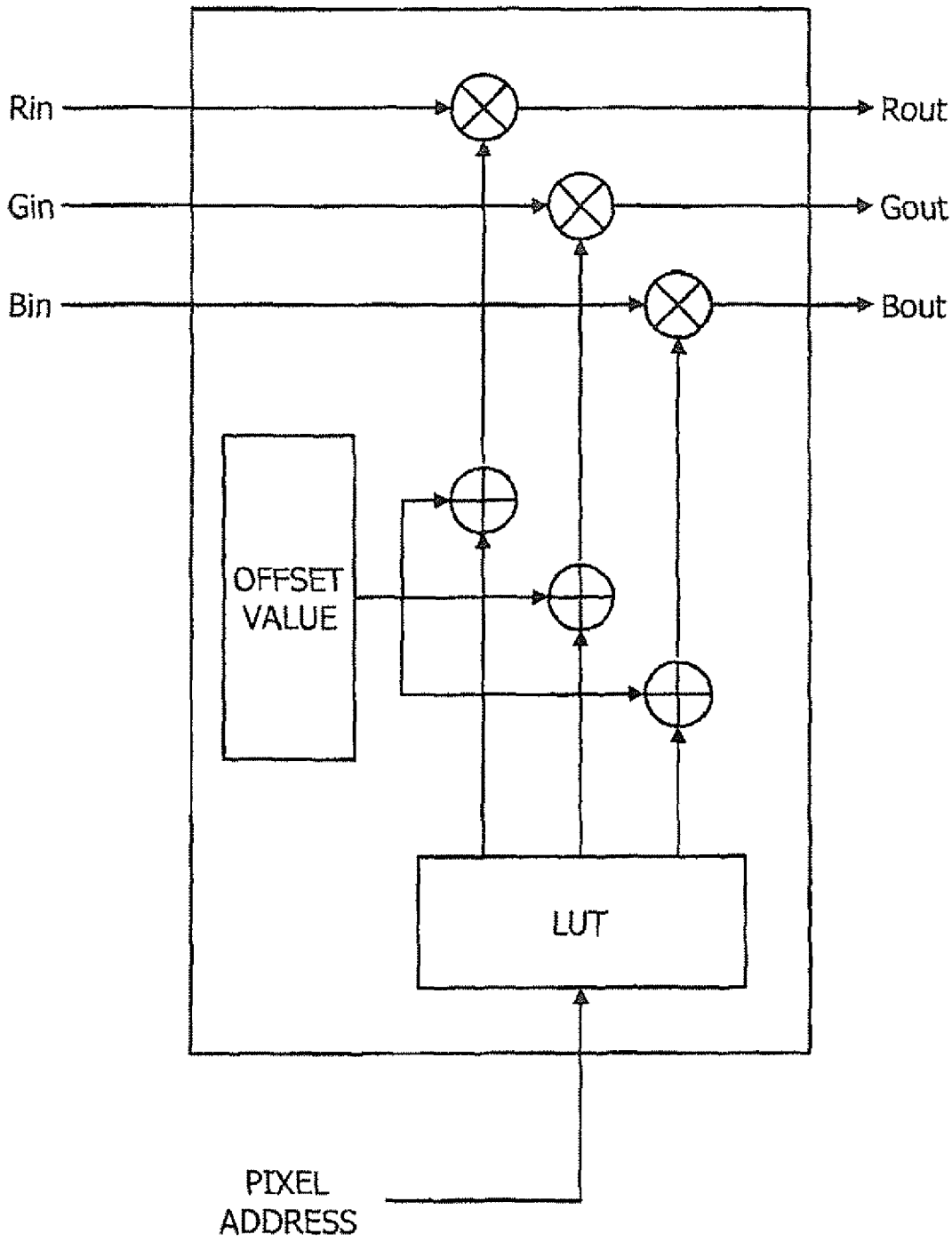
FIG. 9 is a diagram showing configurations of pixel adjustment calculating units A and B.

Configurations of the pixel adjustment multiplication units A and B are shown in FIG. 9. The pixel adjustment multiplication unit includes a circuit which outputs an adjusted value according to a pixel address and a multiplying unit which multiplies the adjustment value, and multiplies an input signal by the adjustment value according to a pixel address of an input video signal to output a resultant signal. A circuit which outputs an adjustment value according to a pixel address includes a LUT (Look-Up table) having differences of the adjustment values from an offset value and an addition circuit which adds the offset value. In the LUT, a variation in characteristic of the pixels (in particular, any one of a phosphor and an electron-emitting device) is stored. This configuration, when the adjustment value has a distribution centered on a certain value, enables highly accurate adjustment relative to a memory size. In the embodiment, the offset value is set to 1. The LUT corresponds to a memory unit in the present invention.

The pixel adjustment multiplication unit A6 and the pixel adjustment multiplication unit B10 adjust a correction value depending on a variation in pixel characteristics. In contrast to this, the conversion coefficient calculating unit 8 adjusts a correction value depending on the types of phosphors of pixels.

Hereafter, several types of pixel characteristics will be described, as well as methods of determining adjustment values for each type of pixel characteristics, which values are the content of the LUT of any one of the pixel adjustment multiplication unit A6 and the pixel adjustment multiplication unit B10 or both.

First Embodiment

In the embodiment, adjustment values are determined while giving attention to difference of phosphor aperture ratios of the pixels as difference of pixel characteristics.

In the step of forming phosphors on a face plate, even though all the pixels are designed to have equal aperture ratios, some error may be caused in an actual manufacturing step. The aperture ratio of the phosphor is a ratio ((phosphor region)/(phosphor region+non-phosphor region) ) of a phosphor region to a sum of the phosphor region and a non-phosphor region in one pixel (picture element). In the embodiment, the aperture ratio is defined as a ratio of an area in which the phosphor is exposed without black matrix or the like to the entire area of one pixel. When all the pixels have constant areas, an adjustment value may be determined according not to the opening ratio (rate) but to an aperture area.

In this case, since backward scattered electrons, which cause halation emission, are distributed regardless of whether it is phosphor region or non-phosphor region (black matrix region), a halation emission luminance caused by the backward scattered electrons changes if the ratios between the phosphor region and the non-phosphor region differs among the pixels.

Figure 8:
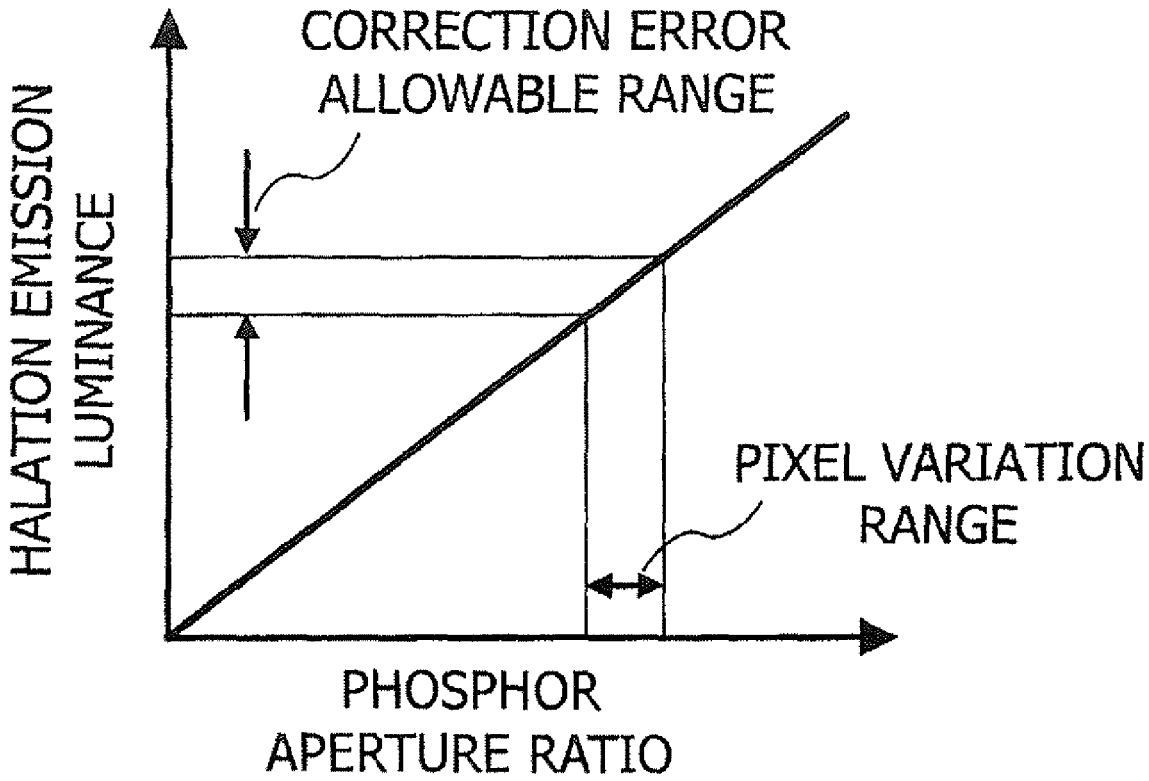
FIG. 8 is a schematic diagram showing a relationship between a phosphor aperture ratio and a halation emission luminance.

More specifically, the halation emission luminance is in proportion to a phosphor aperture ratio (FIG. 8). For this reason, even though the backward scattered electrons are uniformly distributed, the halation emission luminance changes due to the aperture ratios of the phosphors. In order to accurately estimate the halation emission luminance, values being in proportion to the phosphor aperture ratios are used as an adjustment values. When an average of the phosphor aperture ratios of all the pixels is given by Kav, an adjustment value for a pixel having a phosphor aperture ratio K is given by K/Kav. In this manner, the adjustment value corresponding to each of the pixels is determined based on a ratio of an aperture ratio of a corresponding phosphor to the overall average (that is, a variation in phosphor aperture ratio). Since a change in halation emission luminance caused by the phosphor is a characteristic of a halation emission pixel, the adjustment is performed by the pixel adjustment multiplication unit B.

With the above configuration, since halation correction performed in consideration of difference of halation emission luminance caused by a variation in characteristics of the phosphors, an image display having lesser display unevenness can be performed.

A method of manufacturing an image display apparatus according to the embodiment will be described below. Black matrix regions are formed on a glass substrate serving as a face plate, and phosphors are coated on the glass substrate between the black matrixes and then calcined to form light-emitting regions. This step is performed such that ratios of phosphor region to black matrix region are equal in all pixels. In actual manufacturing, errors occur. Hence, phosphor aperture ratios of all the pixels are measured by photographing each light-emitting region and analyzing the images. Aperture ratio K of each of the phosphors is associated with the pixel address and stored in the LUT in form of ratio K/Kav to the average Kav of all the pixels. In this manner, the image display apparatus according to the embodiment is manufactured.

Second Embodiment

In this embodiment, an adjustment value is determined while giving attention to difference of electron scattering efficiencies of phosphors in pixels as difference of pixel characteristics.

In the step of forming phosphors or metal back on a face plate, even though the film thicknesses in all the pixels are designed to be equal, the film thicknesses may slightly varies in an actual manufacturing step. When the film thicknesses of phosphors and metal backs vary in the manufacturing step, the numbers of electrons scattered by the phosphors of the pixels are different from each other.

As a result, halation luminance of the pixels differ among the pixels.

Figure 11:
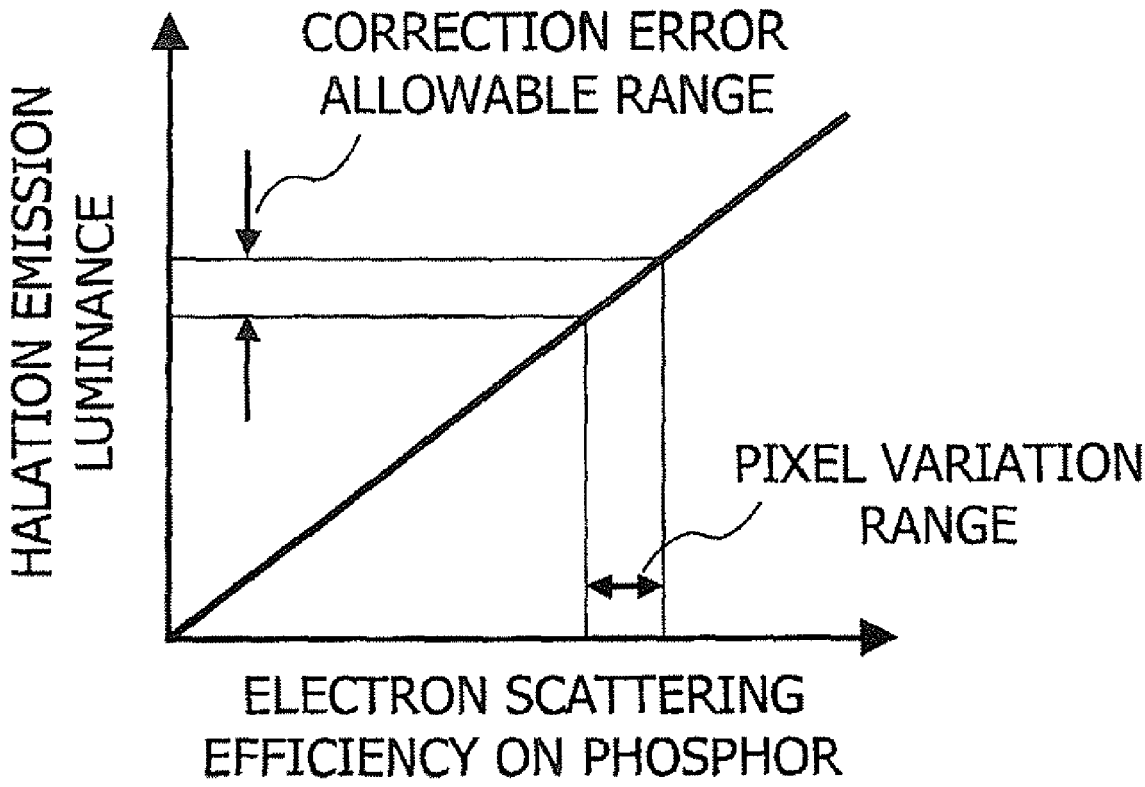
FIG. 11 is a schematic diagram showing a relationship between an electron scattering efficiency and a halation emission luminance on a phosphor.

More specifically, halation emission luminance is in proportion to electron scattering efficiency (FIG. 11). For this reason, as adjustment values, values being in proportion to the electron scattering efficiency are used. When an average of electron scattering efficiencies in the phosphors of all the pixels is given by Lav, an adjustment value for a pixel having a scattering efficiency L is given by L/Lav. Since a change inhalation emission luminance caused by the electron scattering efficiency in the phosphor is a characteristic of an electron scattering pixel, adjustment is performed by the pixel adjustment multiplication unit A6.

The image display apparatus according to the embodiment can be manufactured as follows. After the step of forming light-emitting regions on a face plate, electrons are irradiated on an arbitrary pixel. Peripheral halation emission luminance caused by scattered electrons from the pixel is measured. Measuring light-emitting characteristics of phosphors of the peripheral pixels in advance, the number of scattered electrons from the pixel can be calculated from the halation emission luminance. Therefore, an electron scattering efficiency of an Interested pixel can be measured. The electron scattering efficiencies of all the pixels are measured in the same way, and a ratio L/Lav of a scattering efficiency L of each pixel to an average Lav of all the pixels is stored in an LUT in association with a pixel address. In this manner, the image display apparatus according to the embodiment is manufactured.

Third Embodiment

In this embodiment, an adjustment value is determined in consideration of a difference of I-V (the number of emitted electrons—applied voltage) characteristics (electron emitting characteristics) of electron-emitting devices as a difference between pixel characteristics.

In the step of forming a plurality of electron-emitting devices on a rear plate, even though the characteristics of all the electron-emitting devices are designed to be equal, the characteristics slightly vary in an actual manufacturing step. The number of electrons emitted when a constant voltage is applied may thus vary.

When emission currents vary with the electron-emitting devices even if a constant voltage is applied to electron-emitting devices, there is technique of differentiating drive times of the electron-emitting devices to realize equal luminance. However, even though the luminance of the electron-emitting devices are made equal by this technique, different halation luminance may be obtained due to a relationship between luminance saturation characteristics to time of the phosphors and luminance saturation characteristics to current density. More specifically, even though a certain number of electrons are irradiated as whole, the halation luminance varies if emission current densities and electron-emitting times vary. For example, emission luminance will be different between when electrons with high emission current density are irradiated for a short period of time and when electrons with low emission current density are irradiated for a long period of time.

A method of calculating relationship between halation emission luminance and difference of the I-V characteristics will be described. Emission characteristic L=f(Ie, PW) of the phosphor with respect to electron source drive time PW and emission current Ie of the phosphor is obtained by measuring emission for various combinations of PW and Ie. In this case, it is assumed that only the electron-emitting devices vary and the phosphors do not vary, and thus the emission characteristics L are assumed to be equal for all the phosphors.

Figure 12:
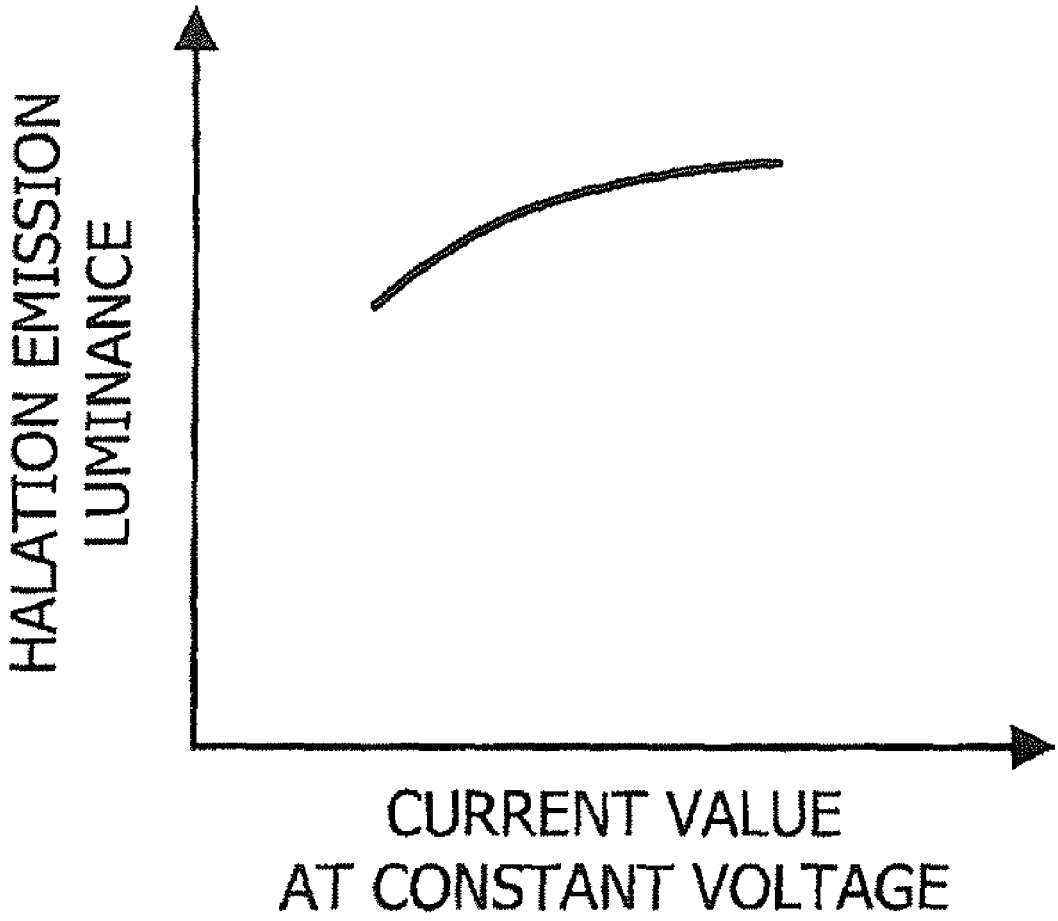
FIG. 12 is a diagram showing a relationship between a fluctuation in current in constant-voltage drive and a halation luminance when a luminance is made constant by giving a drive time difference to the fluctuation in current.

Suppose, a drive time must be set to PW0 in order for a pixel having an emission current Ie0 to satisfy a luminance L0, where the luminance L0 is determined by a signal level of input image data. In the SED panel according to the embodiment, incident density of electrons diffused by phosphor is 0.00007*Ie0, and thus luminance L=f(0.00007*Ie0, PW0) caused with this incident density is halation emission luminance Lh. Calculating the halation emission luminance Lh for each Le, a relationship shown in FIG. 12 is obtained in the embodiment. When halation emission luminance corresponding to an average emission current Ieav is given by Lhav, an adjustment value for a pixel having an emission current value corresponding to the halation emission luminance Lh is given by Lh/Lhav.

Figure 10:
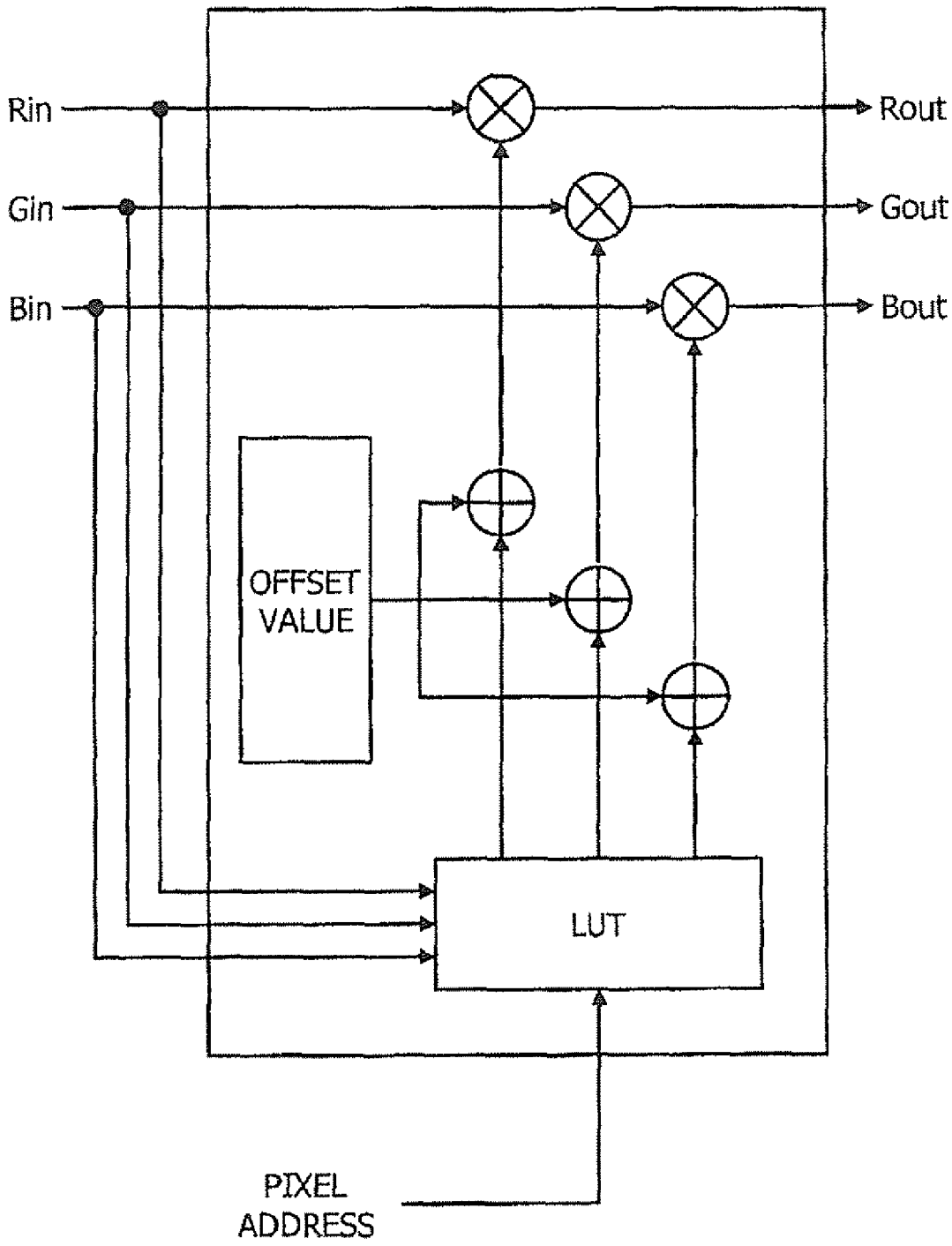
FIG. 10 is a diagram showing configurations of the pixel adjustment calculating units A and B when an adjusted value depending on an input signal is used.

A change in halation emission luminance caused by the electron source I-V characteristic depends on times for which emission currents Ie, which is different for all the electron-emitting devices, are emitted. Since the characteristic is a characteristic of the electron scattering pixel, the halation emission luminance is adjusted by the pixel adjustment multiplication unit A6 The adjustment value Lh/Lhav may also depend on a signal level of image data. In this case, the configuration of the pixel adjustment multiplication unit A6 is so modified that adjustment value depends not only on pixel address but on both pixel address and signal level of the image data (the configuration is shown in FIG. 10), thereby making it possible to perform accurate correction in various signal level.

Fourth Embodiment

In the above embodiments, it is assumed in the explanation that variation of characteristics of pixels depends on the pixels, and thus the halation emission luminance also varies with the pixels. The present invention is not limited to this configuration. In the following explanation, phosphor aperture ratios (first embodiment) are considered as variation in pixel characteristic.

Even though the phosphor aperture ratios vary with the pixels, if the variation of the aperture ratios tends to depend on positions on a face plate, a same adjustment value can be used for a plurality of pixels.

This configuration can be employed when, for example, characteristics of aperture ratios at a central portion and a peripheral portion on the face plate are different from each other due to a method of manufacturing a phosphor.

In the embodiment, the face plate is sectioned into a predetermined number (for example, 4×3=12) regions, and the same value is employed as an adjustment value in the same region. As described above, the tendencies of the aperture ratio characteristics in the different regions change depending on manufacturing methods, a place having almost constant phosphor aperture ratios is sectioned as one region. When a phosphor aperture ratio is uniformly K0 in one section, and when an average of phosphor aperture ratio in the entire region is given by Kav, K0/Kave is applied as an adjustment value to all the pixels in the section.

According to the configuration, in contrast to a configuration in which pixels have unique adjustment values, respectively, the same adjustment value can be shared by a plurality of pixels. For this reason, an image display apparatus having lesser display unevenness can be provided with a small memory capacity.

In this case, the example in which the phosphor aperture ratio according to the first embodiment is considered is described. This can also be applied to the second and third embodiments.

When any one of the pixel adjustment multiplication unit A and the pixel adjustment multiplication unit B or both is used, correction can be performed more accurately with respect to a variation in pixel characteristic. An allowable range of the variation in pixel characteristic can be widened. This moderates necessary accuracy, increases a production yield, and consequently reduces a manufacturing cost in a manufacturing apparatus for an image display apparatus.

Modification

In the embodiment described above, as halation correction, halation luminance that would be generated when spacers was absent is calculated, and emission of halation-blocked light-emitting region blocked by the spacer is compensated by an amount of the blocking. In other words, as an influence of proximate electron-emitting devices on a light-emitting region to be corrected, a halation emission luminance that would be generated if spacers was not used is calculated, which halation emission luminance is caused by electrons blocked by a spacer among electrons irradiated from the proximate electron-emitting devices and scattered at peripheral light-emitting regions. Correction is performed to add the blocked halation emission luminance to a luminance to be corrected. In the correcting method, correction is performed such that uniform halation emission occurs in all the pixels.

However, the halation correcting method is not limited to the above method. For example, correction may be performed to suppress halation emission in all the pixels. In this case, as an influence of the proximate electron-emitting devices on a light-emitting region to be corrected, a halation emission luminance actually generated is calculated, which halation emission luminance is caused by electrons irradiated from the proximate electron-emitting devices and scattered at the peripheral light-emitting regions. Correction is performed such that the halation emission luminance is subtracted from the light-emitting region to be corrected.

In addition to the method of determining an adjustment value from a difference of pixel characteristics, a method of measuring correction errors of pixels after a conventional correcting method is executed and determining an adjustment value to cancel overs and shorts can be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-326213, filed Dec. 18, 2007 which is hereby incorporated by reference herein in its entirety.

What is claimed is:

1. An image display apparatus comprising:

a face plate with a plurality of light-emitting regions;

a rear plate with electron-emitting devices corresponding to the plurality of light-emitting regions, respectively; and a drive circuit that drives the electron-emitting devices, wherein the drive circuit has a correction circuit that calculates a correction value evaluated by influence of emitted electrons from electron-emitting devices which correspond to light-emitting regions around the light-emitting region to be corrected, and corrects a signal input to the electron-emitting device corresponding to the light-emitting region to be corrected based on the correction value, and the correction circuit has at least one adjustment circuit that adjusts the correction value based on variation in electron scattering efficiencies of the light-emitting regions around the light-emitting region to be corrected and variation of amount of light emission in the light-emitting regions to be corrected caused by the scattered electrons from the light-emitting regions around the light-emitting region to be corrected.

2. An image display apparatus according to claim 1, wherein the adjustment circuit has a memory unit that stores characteristics of each light-emitting region relating to the electron scattering efficiency and the amount of light emission caused by the scattered electrons, and adjusts the correction value based on variation of the characteristics stored in the memory unit.

3. An image display apparatus according to claim 1, wherein, when the plurality of light-emitting regions are divided into a predetermined number of sections, the adjustment circuit has a memory unit that stores averages of characteristics of light-emitting regions in each section, the characteristics relating to the electron scattering efficiency and the amount of light emission caused by the scattered electrons, and adjusts the correction value based on the averages of the characteristics stored in the memory unit.

4. A manufacturing method for an image display apparatus comprising a face plate with a plurality of light-emitting regions, a rear plate with electron-emitting devices corresponding to the plurality of light-emitting regions, respectively, and a drive circuit that drives the electron-emitting devices, wherein the drive circuit has a correction circuit that calculates a correction value evaluated by influence of emitted electrons from electron-emitting devices which correspond to light-emitting regions around the light-emitting region to be corrected, and corrects a signal input to the electron-emitting device corresponding to the light-emitting region to be corrected based on the correction value with adjustment according to variation of characteristics of the plurality of light-emitting regions, the method comprising the steps of:

forming the plurality of light-emitting regions on the face plate;

measuring characteristics of the plurality of light-emitting regions; and storing the measured characteristics of the plurality of light-emitting regions, wherein the characteristics of the light-emitting regions includes variation in electron scattering efficiencies of the light-emitting regions around the light -emitting region to be corrected and variation of amount of light emission in the light-emitting regions to be corrected caused by the scattered electrons from the light-emitting regions around the light-emitting region to be corrected.

5. A manufacturing method for an image display apparatus according to claim 4, wherein in the storing step, the characteristics of each light-emitting region relating to the electron scattering efficiency and the amount of light emission caused by the scattered electrons are stored.

6. A manufacturing method for an image display apparatus according to claim 4, wherein in the storing step, sectioning the plurality of light-emitting regions into a predetermined number of regions, averages of characteristics of light-emitting regions in each section are stored, the characteristics relating to the electron scattering efficiency and the amount of light emission caused by the scattered electrons.

7. A manufacturing method for an image display apparatus according to claim 6, wherein the sectioning of the light-emitting regions is performed to section regions having almost the same tendencies as regions in the same section when tendencies of the characteristics of the light-emitting regions change depending on the regions in the step of forming the light-emitting regions.

* * * * *